US011460791B2

(12) United States Patent
Anzai et al.

(10) Patent No.: US 11,460,791 B2
(45) Date of Patent: Oct. 4, 2022

(54) CONNECTION SEAL STRUCTURE, POWDER FEEDING DEVICE, AND POWDER HANDLING DEVICE

(71) Applicant: FUJIFILM Business Innovation Corp., Tokyo (JP)

(72) Inventors: Takashi Anzai, Kanagawa (JP); Satoru Ishii, Kanagawa (JP); Yukihiro Ichiki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/336,969

(22) Filed: Jun. 2, 2021

(65) Prior Publication Data

US 2022/0163904 A1 May 26, 2022

(30) Foreign Application Priority Data

Nov. 20, 2020 (JP) ..... JP2020-193006

(51) Int. Cl.
*G03G 15/08* (2006.01)
*B65D 47/28* (2006.01)

(52) U.S. Cl.
CPC ..... *G03G 15/0886* (2013.01); *B65D 47/28* (2013.01); *G03G 2215/0692* (2013.01); *G03G 2221/1648* (2013.01)

(58) Field of Classification Search
CPC ..... G03G 15/0886; G03G 15/0877; G03G 15/0879; G03G 2215/0692; G03G 2221/1648; B65D 47/26; B65D 47/28; B65D 47/283
USPC ..... 399/105, 258, 262; 222/162, 325, 518, 222/559, DIG. 1; 141/21, 22
See application file for complete search history.

(56) References Cited

U.S. PATENT DOCUMENTS

| | | | | |
|---|---|---|---|---|
| 5,650,841 | A | 7/1997 | Matsuda et al. | |
| 2012/0257912 | A1* | 10/2012 | Hasebe | G03G 15/0886 399/262 |
| 2013/0223873 | A1* | 8/2013 | Manabe | G03G 21/105 399/102 |
| 2015/0277286 | A1* | 10/2015 | Mizutani | G03G 21/10 399/258 |
| 2017/0031271 | A1* | 2/2017 | Fujii | G03G 15/0886 |
| 2017/0153576 | A1* | 6/2017 | Fujimura | G03G 15/0817 |
| 2021/0080868 | A1* | 3/2021 | Yamada | G03G 15/0867 |

FOREIGN PATENT DOCUMENTS

| | | |
|---|---|---|
| JP | 3236124 B2 | 12/2001 |
| JP | 3919467 B2 | 5/2007 |

* cited by examiner

*Primary Examiner* — Robert B Beatty
(74) *Attorney, Agent, or Firm* — Sughrue Mion, PLLC

(57) ABSTRACT

A connection seal structure includes: a first structure including a connector that is removably connected; and a second structure that includes a connectable portion that allows the connector to be received thereon and connected thereto, the connectable portion allowing an elastic member including an elastic layer to be attached to at least a portion of the connectable portion facing the connector. The elastic member has an end bent in such a direction as not to come into contact with the connector while the connector is inserted or removed, the end being on a side closer to the connector while the connector is inserted, and the connection seal structure further comprises a retainer that keeps the bent end of the elastic member in a bent state.

9 Claims, 8 Drawing Sheets

CONNECTION SEAL STRUCTURE, POWDER FEEDING DEVICE, AND POWDER HANDLING DEVICE

CROSS-REFERENCE TO RELATED APPLICATIONS

This application is based on and claims priority under 35 USC 119 from Japanese Patent Application No. 2020-193006 filed Nov. 20, 2020.

BACKGROUND

(i) Technical Field

The present disclosure relates to a connection seal structure, a powder feeding device, and a powder handling device.

(ii) Related Art

Japanese Patent No. 3919467 (for example, paragraphs [0063] to [0067], and FIGS. 8 to 10) describes a seal structure, and a developer feeding device and an image forming apparatus each including the seal structure. As a sealant surrounding a toner discharge port formed in a discharge port cover casing in a toner feeding device to which a toner bottle is removably attached, the seal structure includes a sealant including a base layer made of an elastic material and a rubbing layer. The rubbing layer is formed from a sheet bonded to a surface of a developer container in a developing unit that rubs against the sealant at a toner inlet port. A far end portion of the rubbing layer in a direction in which the sealant including the rubbing layer moves when the toner feeding device is slidably inserted into a copier body protrudes beyond the far end of the base layer. The protruding far end portion of the rubbing layer is bent at the base end of the base layer toward a side surface of the casing to be bonded to the side surface.

SUMMARY

Aspects of non-limiting embodiments of the present disclosure relate to a connection seal structure, a powder feeding device, and a powder handling device capable of further reducing breakage of part of an elastic member attached to at least a portion of a connectable portion facing a connector due to insertion and removal of the connector, than in a structure not including a retainer that keeps bending of a bent end of the elastic member. The connectable portion allows a removable connector to be received thereon and connected thereto.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a connection seal structure including: a first structure including a connector that is removably connected; and a second structure that includes a connectable portion that allows the connector to be received thereon and connected thereto, the connectable portion allowing an elastic member including an elastic layer to be attached to at least a portion of the connectable portion facing the connector, wherein the elastic member has an end bent in such a direction as not to come into contact with the connector while the connector is inserted or removed, the end being on a side closer to the connector while the connector is inserted, and wherein the connection seal structure further comprises a retainer that keeps the bent end of the elastic member in a bent state.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure (or simply referred to as "exemplary embodiments" herein) will be described below with reference to the drawings.

First Exemplary Embodiment

Figure 1A:
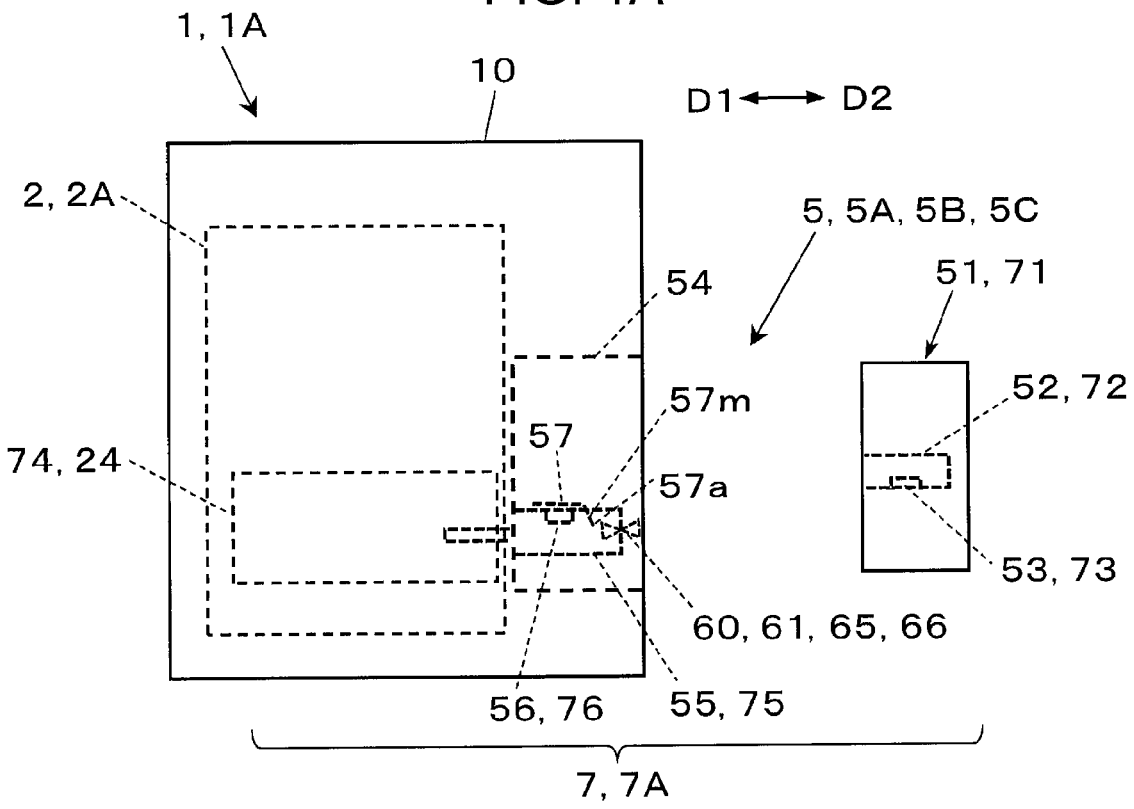
FIG. 1A is a schematic diagram of a connection seal structure according to a first exemplary embodiment in a disconnected state.
Figure 1B:
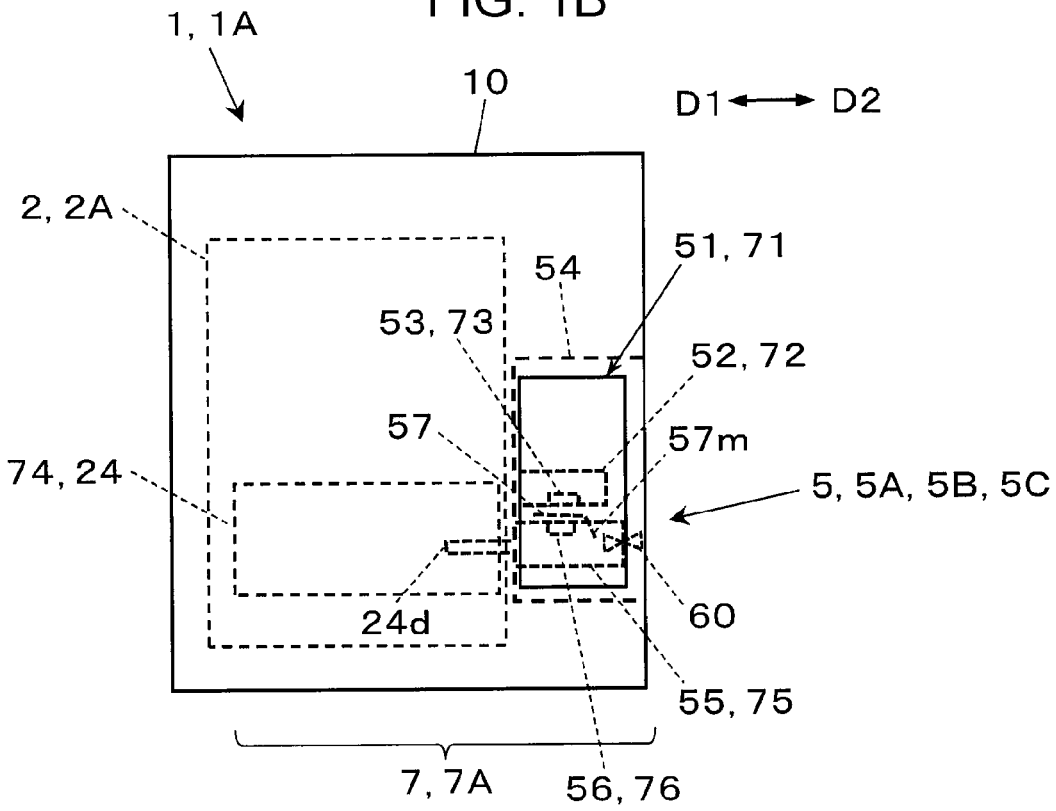
FIG. 1B is a schematic diagram of the connection seal structure illustrated in FIG. 1A in a connected state.

FIGS. 1A and 1B schematically illustrate a connection seal structure 5 according to a first exemplary embodiment, and a powder feeding device 7 or a powder handling device 1 including the connection seal structure 5. FIG. 1A illustrates the connection seal structure 5 in a disconnected state, and FIG. 1B illustrates the connection seal structure 5A in a connected state.

Structure of Connection Seal Structure

The connection seal structure 5 includes a first structure 51 and a second structure 54. The first structure 51 includes a connector 52 that is removably connected. The second structure 54 includes a connectable portion 55 that allows the connector 52 to be received thereon and connected thereto. To at least a portion of the connectable portion 55 facing the connector 52, an elastic member 57 including an elastic layer 571 is attached.

The connection seal structure 5 is capable of preventing leakage of powder through a connected portion between the connector 52 and the connectable portion 55 during, for example, movement of the powder between the connector 52 and the connectable portion 55.

The first structure 51 is, for example, a device or a structure that accommodates powder to be fed. The first structure 51 illustrated in FIGS. 1A and 1B is a powder container that accommodates powder to be fed.

The connector 52 in the first structure 51 serves as a structural portion that transports powder to be fed. The connector 52 serves as a structural portion that includes, for example, a cylindrical body defining a path space for transporting powder to be fed, and a transporting member that transports powder in the path space of the body. The connector 52 also includes, at part of the body, a discharge port 53 through which powder is discharged.

The second structure 54 is, for example, a device or a structure that receives powder fed from the first structure 51. The second structure 54 illustrated in FIGS. 1A and 1B is a device or structure to which the first structure 51 is removably attached.

The connectable portion 55 in the second structure 54 serves as a structural portion that receives powder discharged and fed from the connector 52 while having the connector 52 connected thereto. The connectable portion 55 is a structural portion that includes a body defining a path space for transporting the received powder and a portion that allows the connector 52 to be received thereon and connected thereto, and a transport member that transports powder in the path space. The connectable portion 55 also includes an inlet port 56 that receives powder at a portion (at a portion of the body). The inlet port 56 is located to face the discharge port 53 in the connector 52 when the connector 52 is inserted into and connected to the connectable portion 55.

The elastic member 57 is a member located between the connector 52 and the connectable portion 55, and attached to prevent leakage of a substance such as powder through a gap at a connected portion between the connector 52 and the connectable portion 55.

The elastic member 57 includes an elastic layer 571 serving as a base layer, and a cover layer 572 covering the surface of the elastic layer 571 facing the connector 52. The elastic layer 571 is made of a material such as polyurethan foam or other soft foam. The cover layer 572 is made of a material such as felt.

When the elastic member 57 is attached to the connectable portion 55 with, for example, an adhesive, an adhesive layer (such as an adhesive tape or a bonding-agent layer) is disposed on the surface of the elastic layer 571 opposite to the surface receiving the cover layer 572.

The elastic member 57 is attached to at least a portion of the connectable portion 55 facing the connector 52.

At least a portion of the connectable portion 55 facing the connector 52 here includes, for example, a portion surrounding the inlet port 56 that is to face the discharge port 53 in the connector 52 while the connector 52 is connected. When including the cover layer 572, the elastic member 57 is attached to the connectable portion 55 while leaving the cover layer 572 exposed as a top surface. Thus, in the elastic member 57 attached to the connectable portion 55, the top surface of the elastic layer 571 is covered with the cover layer 572 to be left unexposed to the outside.

In the connection seal structure 5, an end 57*a* of the elastic member 57 on a side closer to the connector 52 when the connector 52 is to be inserted into the connectable portion 55 for connection is bent in such a direction as not to touch the connector 52 that is to be inserted or removed.

The end 57*a* of the elastic member 57 on a side closer to the connector 52 is an end that the inserted connector 52 faces first while being inserted. An area (bent area) 57*m* in FIGS. 1A and 1B is an actually bent area at the bent end 57*a* of the elastic member 57. The bent end 57*a* of the elastic member 57 illustrated in FIGS. 1A and 1B is, for example, bent obliquely downward in the direction of gravity.

The direction in which the connectable portion 55 does not come into contact with the connector 52 is a direction away from a direction (insertion direction) D1 in which the connector 52 is inserted. In other words, the direction in which the connectable portion 55 does not come into contact with the connector 52 is a direction crossing at least the direction D1 in which the connector 52 is inserted.

Thus, the bent area 57*m* at the bent end 57*a* of the elastic member 57 is prevented from being touched by the connector 52 when the connector 52 is inserted into and removed from the connectable portion 55.

The connection seal structure 5 includes a retainer 60 that keeps the bent end of the elastic member 57 in a bent state.

Keeping in a bent state refers to leaving the bent elastic member 57 without being deformed in a direction toward the connector 52 with the effect of insertion or removal of the connector 52.

The retainer 60 according to the first exemplary embodiment includes a pressing member 61 that presses the bent end 57*a* of the elastic member 57 against a portion 55*d* of the connectable portion 55 in the direction D1 in which the connector 52 is inserted.

The portion 55*d* of the connectable portion 55 is, for example, an existing portion such as a side surface located closest to the bent area 57*m* at the bent end 57*a* of the elastic member 57. Alternatively, the portion 55*d* of the connectable portion 55 may be an additional component.

The retainer 60 including the pressing member 61 will be described in detail, later.

The connection seal structure 5 including the retainer 60 formed from the pressing member 61 (herein, this connection seal structure will be described as a connection seal structure 5A) is an effective seal structure capable of preventing leakage of powder through the connected portion between the connector 52 and the connectable portion 55 regardless of repeated insertion and removal of the connector 52 when, for example, the powder is moved between the connector 52 and the connectable portion 55.

Structure of Powder Feeding Device Including Connection Seal Structure

As illustrated in FIGS. 1A and 1B, the connection seal structure 5 (5A) according to the first exemplary embodiment is used as a connection seal structure in the powder feeding device 7.

The powder feeding device 7 includes a powder feeding structure 71, a powder receiving structure 74, and the connection seal structure 5. The powder feeding structure 71 includes a connector 72 that is removably connected, and a discharge port 73 disposed in the connector 72 to discharge powder to be fed. The powder receiving structure 74 includes a connectable portion 75 that allows the connector 72 to be received thereon and connected thereto, and an inlet port 76 formed in the connectable portion 75 and disposed to face the discharge port 73 to receive powder discharged from the discharge port 73. The connection seal structure 5 is attached to a portion that covers at least a portion of the connectable portion 75 surrounding the inlet port 76, and includes an elastic member 57 including an elastic layer 571 that prevents leakage of powder between the connectable portion 75 and the connector 72.

The connection seal structure 5 is formed from the connection seal structure 5A described above.

The powder feeding structure 71 is a structure for feeding powder, corresponding to the first structure 51 in the connection seal structure 5A. Examples of the powder feeding structure 71 include a fixed structure such as a hopper, in addition to a replaceable container. When the powder feeding structure 71 is a fixed structure, the connector 72 may be either fixed or movable.

The connector 72 in the powder feeding structure 71 corresponds to the connector 52 in the connection seal structure 5A. The discharge port 73 in the connector 72 corresponds to the discharge port 53 in the connection seal structure 5A.

The powder receiving structure 74 is a structure for the powder receiving purpose substantially corresponding to the second structure 54 in the connection seal structure 5A. This powder receiving structure 74 may have a function of handling the received powder, and examples of the powder receiving structure 74 include a device having a powder applying function. Alternatively, the powder receiving structure 74 may have a function of transporting the received powder further forward, and examples of the powder receiving structure 74 include a transportation device serving as a relay that transports powder.

The connectable portion 75 in the powder receiving structure 74 corresponds to the connectable portion 55 in the connection seal structure 5A. The inlet port 76 in the connectable portion 75 corresponds to the inlet port 56 in the connection seal structure 5A.

Now, the connection seal structure 5A including the retainer 60 including the pressing member 61 and the powder feeding device 7 including the connection seal structure 5A will be described in detail with reference to, for example, FIGS. 2 and 3.

Figure 2:
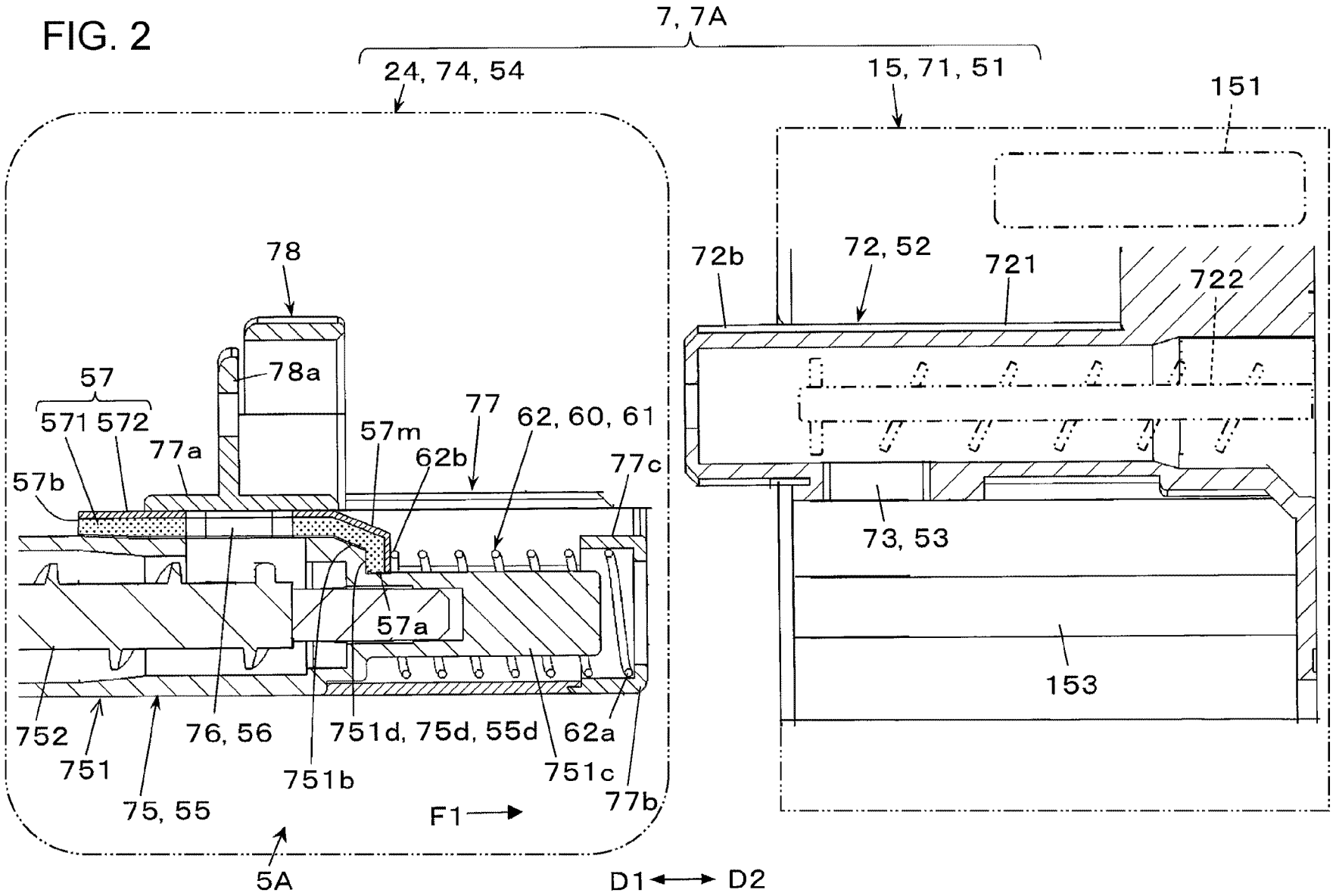
FIG. 2 is a schematic diagram of a powder feeding device including the connection seal structure according to the first exemplary embodiment in a disconnected state, partially illustrating in a cross section.

FIG. 2 illustrates the connection seal structure 5A and the powder feeding device 7 in a disconnected state. FIG. 3 illustrates the connection seal structure 5A and the powder feeding device 7 in a connected state.

Figure 3:
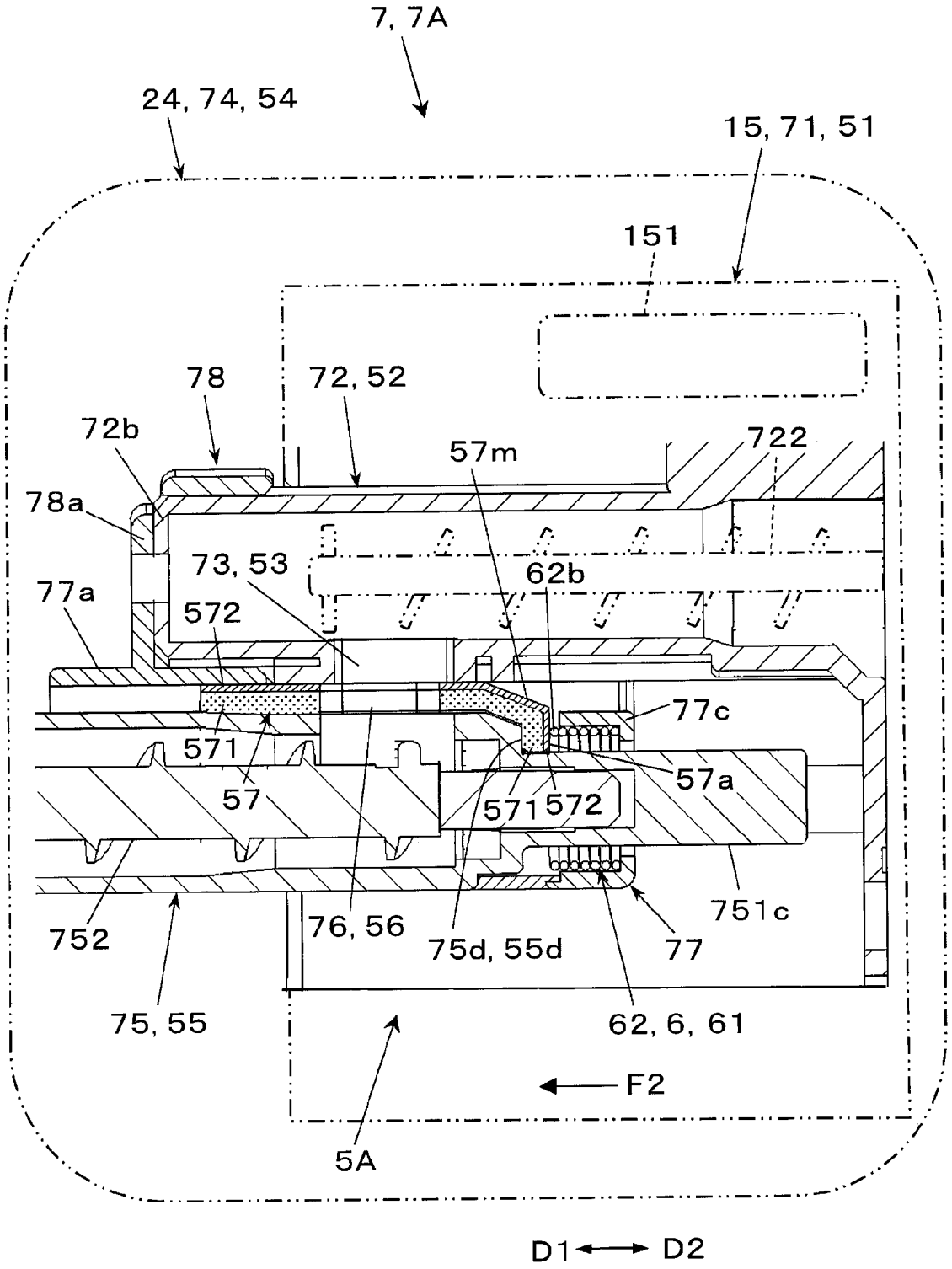
FIG. 3 is a schematic diagram of a powder feeding device including the connection seal structure illustrated in FIG. 2 in a connected state, partially illustrating in a cross section.

A powder container 15 that accommodates powder to be fed is used in portions of the connection seal structure 5A and the powder feeding device 7 illustrated in FIGS. 2 and 3 to serve as the first structure 51 and the powder feeding structure 71. A container attachment structure or device that allows the powder container 15 to be removably attached thereto is used as the second structure 54 in the connection seal structure 5A. A device that receives powder to be fed is used as the powder receiving structure 74 in the powder feeding device 7.

Here, when a developer is used as an example of powder, the powder feeding device 7 serves as a developer feeding device 7A, and the powder receiving structure 74 serves as, for example, a developing device 24 that develops a latent image with a developer into a visible image.

The powder container 15 includes a powder accommodating portion 151 that accommodates powder. When the powder receiving structure 74 serves as the developing device 24, the powder accommodated in the powder container 15 is a developer (such as toner). The powder container 15 includes, as the connector 52, a connector 72 that discharges powder accommodated in the powder accommodating portion 151 to a destination.

The connector 72 is, for example, a structural portion disposed below the powder accommodating portion 151. As illustrated in, for example, FIG. 2, the connector 72 includes a cylindrical body 721 having a powder transportation space, and a transporting member 722 such as a screw auger that rotates and transports powder in the transportation space of the body 721. The connector 72 includes the discharge port 73, through which powder transported by the transporting member 722 is discharged, at a position that is to face the connectable portion 75 in the developing device 24 serving as the powder receiving structure 74 when the connector 72 is connected to the connectable portion 75. A guide portion 153 in FIG. 2 is, for example, a groove that guides the connector 72 in an insertion-removal direction D during insertion and removal of the connector 72.

The developing device 24 serving as an example of the powder receiving structure 74 is a developing device included in an image forming device 2A, which is an example of a powder applying device 2 in the image forming apparatus 1A. The image forming apparatus 1A is an example of the powder handling device 1 schematically illustrated in FIGS. 1A and 1B. The image forming device 2A is a device that forms images with a developer with, for example, electrophotography.

To replenish the developer in the powder accommodated in the powder container 15, the developing device 24 includes a container attachment structure that allows the powder container 15 to be removably attached thereto. As illustrated in FIGS. 1A and 1B, the container attachment structure is disposed at one side surface portion in a housing 10 of the image forming apparatus 1A to serve as a structural portion (second structure 54).

The developing device 24 includes the connectable portion 75 that allows the connector 72 in the powder container 15 to be received thereon and connected thereto. As illustrated in FIGS. 1A and 1B, the connectable portion 75 extends from the first end of the developing device 24 to the container attachment structure of the powder container 15. A replenishment transport path 24*d* in FIGS. 1A and 1B allows the developer received by the connectable portion 75 to be transported therealong into the developing device 24.

As illustrated in FIG. 2 and other drawings, the connectable portion 75 includes a cylindrical body 751 having a developer transportation space, and a transporting member 752 such as a screw auger that rotates and transports the developer in the transportation space in the body 751. The connectable portion 75 also includes an inlet port 76, which receives the developer discharged through the discharge port 73 of the connector 72 in the powder container 15, at a position that is to face the discharge port 73 during insertion of the connector 72.

The body 751 of the connectable portion 75 according to the first exemplary embodiment has a slope 751*b*, which is a tapered and inclined far end disposed on the outer side of the inlet port 76. The body 751 also has a cylindrical protrusion 751*c*, which protrudes further outward from the center portion of the tapered far end. The body 751 also has a side wall surface 751*d*, which is a surface extending substantially in the vertical direction, between the slope 751*b* and the protrusion 751*c*. A bearing for the rotation shaft of the transporting member 752 is disposed inside the protrusion 751*c*.

Figure 4A:
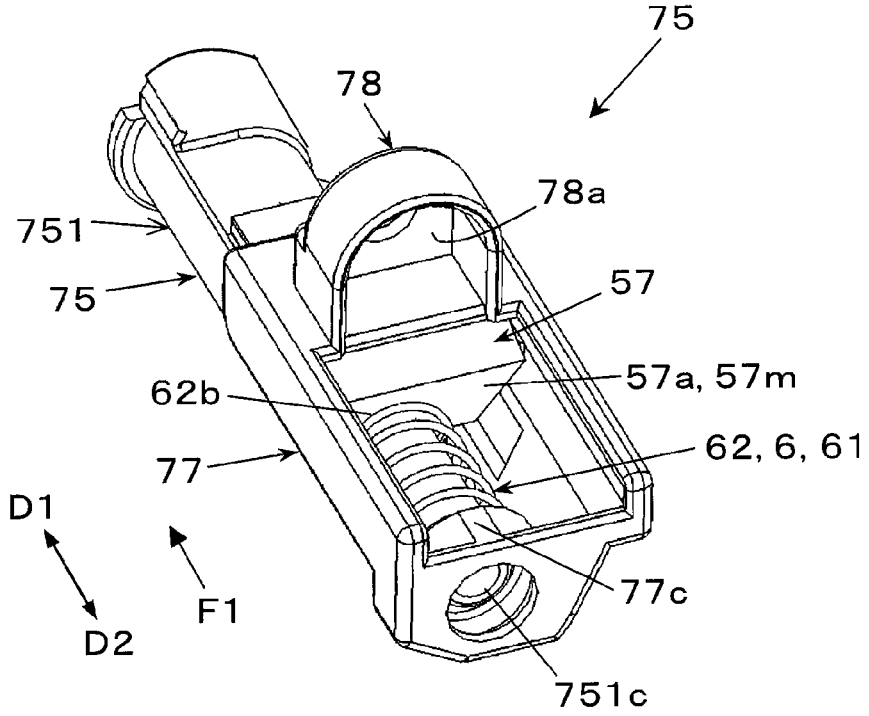
FIG. 4A is a perspective view of an inlet port of a connectable portion in the connection seal structure illustrated in FIG. 2 in a state of being covered with a lid.
Figure 4B:
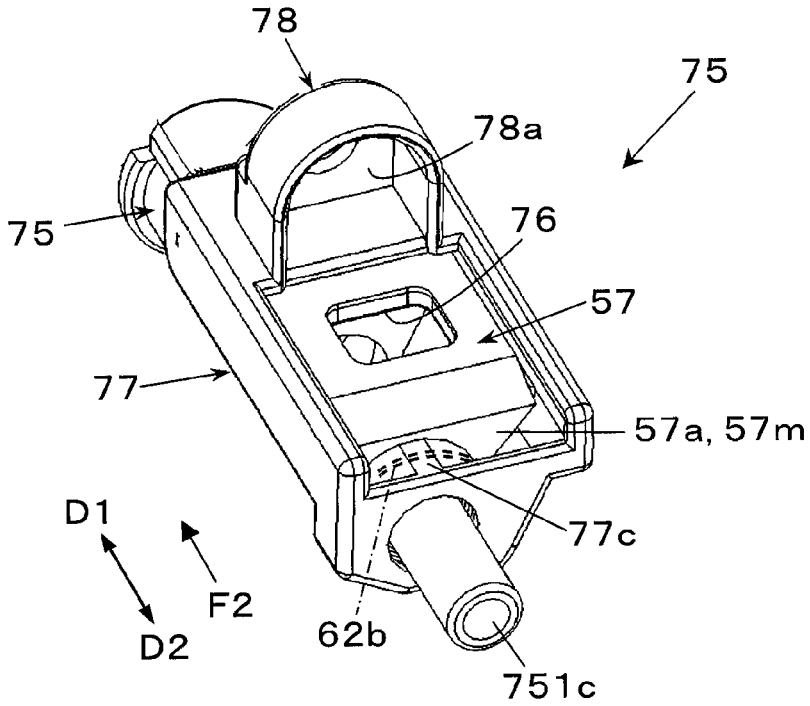
FIG. 4B is a perspective view of the inlet port of the connectable portion illustrated in FIG. 4A in a state of being uncovered with the lid.

As illustrated in, for example, FIGS. 2, 4A, and 4B, the connectable portion 75 includes a lid (shutter) 77 that renders the inlet port 76 opened or closed.

The lid 77 has a shape and a structure including a body 77*a* that covers the inlet port 76 to close the inlet port 76. The lid 77 is attached to an outer circumferential portion of the body 751 of the connectable portion 75 to be movable within a limited range in a direction parallel to the insertion-removal direction D of the connector 72 of the powder container 15.

As illustrated in FIG. 2 or 4A, the lid 77 is kept being closed by being urged by a spring member 62 in a direction D2, opposite to the direction D1 in which the connector 72 is inserted. The spring member 62 is disposed downstream from the inlet port 76 in the opposite direction D2.

The opposite direction D2, which is opposite to the direction D1 in which the connector 72 is inserted, corresponds to the direction in which the connector 72 is drawn out (drawing-out direction). An example used as the spring member 62 is a coil spring.

As illustrated in FIG. 2, the spring member 62 formed from a coil spring according to the first exemplary embodiment has a coil portion into which a protrusion 571*c* of the body 751 of the connectable portion 75 is inserted to be held by the coil portion. The spring member 62 has a first end 62*a* accommodated in and brought into contact with a cylindrical spring accommodating portion 77*c* disposed at a front end 77*b* of the lid 77, and a second end 62*b* attached to the side wall surface 751*d* of the body 751 of the connectable portion 75 to be capable of touching the side wall surface 751*d*.

When the connector 72 is not connected to the connectable portion 75, the spring member 62 is held while being slightly compressed between the spring accommodating portion 77*c* and the side wall surface 751*d* to urge the lid 77 in the direction of arrow D2 with a spring force F1. Thus, the spring member 62 functions to keep the inlet port 76 closed (to keep the inlet port 76 in a closed position).

The lid 77 moves in association with insertion and removal of the connector 72. The lid 77 includes a receiver 78 that receives an effect of colliding of a far end 72*a* of the connector 72 while being inserted in an open direction (direction indicated with arrow D1).

The receiver 78 is a structural portion that protrudes upward from the upper surface of the body 77*a* of the lid 77 and that has an arch shape to receive the far end 72*a* of the connector 72. The receiver 78 has an inner wall surface 78*a*, against which the far end 72*a* of the connector 72 collides, in its inside that receives the far end 72*a* of the connector 72.

As illustrated in FIG. 2, the elastic member 57 includes the elastic layer 571 and the cover layer 572, and, for example, is attached to a portion of the connectable portion 75 surrounding the inlet port 76 with a double-sided adhesive tape not illustrated.

As illustrated in FIGS. 2 and 4B, the elastic member 57 has, for example, a rectangular shape in a plan view, and a through hole at a portion facing the inlet port 76.

The end 57*a* of the elastic member 57 on a side closer to the connector 72 when the connector 72 is inserted into the connectable portion 75 is bent in such a direction as not to come into contact with the connector 72 while the connector 72 is inserted or removed. As illustrated in FIG. 2, the elastic member 57 according to the first exemplary embodiment has the end 57*a* located on a side closer to the connector 72 bent to follow the slope 751*b* at the far end of the body 751 in the connectable portion 75, and further bent to follow the side wall surface 751*d* extending substantially vertically from the inclined far end of the slope 751*b*.

Retainer Formed from Pressing Member

As illustrated in FIGS. 2 and 4A, the retainer 60 in the connection seal structure 5A is formed from a pressing member 61 that presses the bent end 57*a* of the elastic member 57 against a portion 75*d* of the connectable portion 75 in the direction D1 in which the connector 72 is inserted. The pressing member 61 is formed from the spring member 62.

The spring member 62 serving as an example of the pressing member 61 brings the end 62*b*, which is to be brought into contact with the side wall surface 751*d* serving as the portion 75*d* of the connectable portion, into contact with the bent end 57*a* of the elastic member 57, and then presses the bent end 57*a* against the side wall surface 751*d*.

Here, the end 62*a* of the spring member 62 is brought into contact with a portion of the bent area 57*m* at the bent end 57*a* of the elastic member 57, the portion being in contact with the side wall surface 751*d*. The end 62*a* of the spring member 62 here is in contact with the cover layer 572 of the elastic member 57.

Thus, in the connection seal structure 5A, the bent end 57*a* of the elastic member 57 is pressed by the side wall surface 751*d*, which is the portion 75*d* of the connectable portion, with the spring force F1 of the spring member 62. Thus, the bent end 57*a* of the elastic member 57 is kept in a bent state. A portion of the elastic layer 571 in the elastic member 57 here pressed by the end 62*b* of the spring member 62 is compressed between the end 62*b* and the side wall surface 751*d* of the connectable portion.

In the connection seal structure 5A, the elastic layer 571 in the elastic member 57 extends to face the side wall surface 751*d* of the connectable portion. In the connection seal structure 5A, the bent area 57*m* (elastic layer 571) at the bent end 57*a* of the elastic member 57 is in contact with the slope 751*b* and the side wall surface 751*d* of the body 751 of the connectable portion 75, and is bonded to the slope 751*b* and the side wall surface 751*d* with a double-sided tape, not illustrated.

The bent area 57*m* at the bent end 57*a* of the elastic member 57 may be in contact with the slope 751*b* and the side wall surface 751*d* without being bonded to the slope 751*b* and the side wall surface 751*d*.

However, to reliably keep the elastic member 57 in a bent state or to eliminate a gap between the elastic member 57 and the slope 751*b* and the side wall surface 751*d* of the body 751 of the connectable portion 75, preferably, the bent area 57*m* at the bent end 57*a* of the elastic member 57 is bonded to the slope 751*b* and the side wall surface 751*d*, besides being in contact with the slope 751*b* and the side wall surface 751*d*.

Connection of Connector to Connectable Portion

In the powder feeding device 7 (developer feeding device 7A) to which the connection seal structure 5 is applied, the connector 72 in the powder container 15 is connected to the connectable portion 75 in the developing device 24 in the following manner.

Specifically, in the powder feeding device 7, the connector 72 is moved toward the connectable portion 75 in the direction D1 in which the connector 72 is inserted.

Here, the connector 72 moves toward the connectable portion 75 while being guided by the guide portion 153, and then moves while having a far end 72*b* inserted into the receiver 78 in the connectable portion 75 and colliding against the inner wall surface 78*a*. Thus, as illustrated in FIG. 4B, the lid 77 in the connectable portion 75 is moved together with the connector 72 in the direction D1 in which the connector 72 is inserted against the spring force F1 of the spring member 62, and finally leaves the inlet port 76 in the connectable portion 75 in an open state. Here, the spring member 62 is compressed by being pushed in the direction of arrow D1 by the spring accommodating portion 77*c* moving together with the movement of the lid 77 in the direction of arrow D1 (FIG. 3).

As illustrated in FIG. 3, in the powder feeding device 7, the discharge port 73 in the connector 72 and the inlet port 76 in the connectable portion 75 face each other to be connected to each other, and the connector 72 is thus connected to the connectable portion 75. When the connector 72 is connected to the connectable portion 75, the connector 72 is kept being fixed and stationary with respect to the connectable portion 75.

Here, a lid not illustrated that renders the discharge port 73 opened or closed is disposed inside the body 721 of the connector 72. The lid renders the discharge port 73 open when the connector 72 is connected to the connectable portion 75.

As illustrated in FIG. 3, in the powder feeding device 7 where the connector 72 is connected to the connectable portion 75, the elastic member 57 in the connectable portion 75 of the connection seal structure 5 is in contact with the outer peripheral portion of the connector 72 surrounding the discharge port 73. Thus, in the powder feeding device 7, a gap between the portion of the connector 72 around the discharge port 73 and a portion of the connectable portion 75 around the inlet port 76 is closed by the elastic member 57 of the connection seal structure 5.

In the powder feeding device 7, when the connector 72 is to be connected to the connectable portion 75, a lower portion of the connector 72 passes by the elastic member 57 attached to the upper surface of the connectable portion 75 while coming into contact with the elastic member 57.

Here, the lower portion of the connector 72 does not come into contact with the bent area 57*m* at the bent end 57*a* of the elastic member 57 while the connector 72 is inserted.

On the other hand, the portion of the elastic member 57 other than the bent area 57*m* comes into contact with the lower portion of the inserted connector 72 and is rubbed by the lower portion in the direction of arrow D1 to receive external force. Here, since the spring member 62, serving as the pressing member 61 of the retainer 60, is pressed against the side wall surface 751*d*, serving as a portion of the connectable portion 75, the bent area 57*m* at the bent end 57*a* of the elastic member 57 is retained in a bent state without being deformed by the external force.

Here, the bent area 57*m* at the bent end 57*a* of the elastic member 57 receives a larger spring force F2 (>F1) for restoration from the compressed spring member 62, and the portion of the elastic layer 571 pressed against the side wall surface 751*d* of the connectable portion 75 by the end 62*b* of the spring member 62 is compressed with a stronger force than other portions. Thus, the bent area 57*m* of the elastic member 57 is in pressure contact with the side wall surface 751*d* to more reliably close the gap.

Removal of Connector from Connectable Portion

In the powder feeding device 7 (developer feeding device 7A) to which the connection seal structure 5 is applied, the connector 72 in the powder container 15 is disconnected from the connectable portion 75 in the developing device 24 in the following manner.

Specifically, in the powder feeding device 7, the connector 72 is moved in the drawing-out direction D2 to be spaced apart from the connectable portion 75.

Here, the connector 72 moves in a direction apart from the connectable portion 75 while being guided by the guide portion 153, and then moves while having the far end 72*b* removed from the inner wall surface 78*a* of the receiver 78 in the connectable portion 75. Thus, as illustrated in FIG. 4A, the lid 77 in the connectable portion 75 is moved together with the connector 72 while receiving the spring force F2 of the compressed spring member 62 in the drawing-out direction D2 of the connector 72, and finally renders the inlet port 76 in the connectable portion 75 in a closed state. Here, the spring member 62 is expanded to be restored in the direction of arrow D2 by the spring accommodating portion 77*c* that moves together with the movement of the lid 77 in the direction of arrow D2, and reduces its compression (FIGS. 2 and 4A).

As illustrated in FIG. 2, in the powder feeding device 7, the connector 72 becomes separated and disconnected from the connectable portion 75 (disconnected state), and the powder container 15 is removed from the developing device 24.

Here, the lid, not illustrated, disposed inside the body 721 of the connector 72 renders the discharge port 73 closed when the connector 72 moves away from the connectable portion 75.

In the powder feeding device 7 where the connector 72 is disconnected and spaced apart from the connectable portion 75, when the connector 72 is to be drawn out from the connectable portion 75, the lower portion of the connector 72 passes by the elastic member 57 attached to the upper surface of the connectable portion 75 while coming into contact with the elastic member 57.

Here, the lower portion of the connector 72 does not come into contact with the bent area 57*m* at the bent end 57*a* of the elastic member 57 when the connector 72 is drawn out.

On the other hand, the portion of the elastic member 57 other than the bent area 57*m* comes into contact with the lower portion of the drawn-out connector 72 and is rubbed by the lower portion in the direction of arrow D2 to receive external force. Here, since the spring member 62, serving as the pressing member 61 of the retainer 60, is pressed against the side wall surface 751*d*, serving as a portion of the connectable portion 75, the bent area 57*m* at the bent end 57*a* of the elastic member 57 is retained in a bent state without being deformed by the external force.

The powder feeding device 7 (developer feeding device 7A) including the connection seal structure 5A further prevents the portion of the elastic member 57 attached to at least a portion of the connectable portion 75, in the developing device 24 serving as an example of the powder receiving structure 74, on a side closer to the connector 72 from being broken by insertion and removal of the connector 72 of the powder container 15, than in a structure not including the retainer 60 (the pressing member 61 formed from the spring member 62) that keeps the bent end 57*a* of the elastic member 57 in a bent state. The powder container 15 serves as an example of the powder feeding structure 71 of the connectable portion 75.

In other words, if the connection seal structure 5A does not include the retainer 60 that keeps the bent end 57*a* of the elastic member 57 in a bent state, for example, the bent end 57*a* of the elastic member 57 may receive external force when coming into contact with the inserted or removed connector 72, and be deformed so as to be spaced apart from the slope 751*b* or the side wall surface 751*d* of the connectable portion 75. Thus, the elastic layer 571 may come into direct contact with the connector 72 or receive external force through the cover layer 572, and may thus be broken, for example, ruptured. However, the connection seal structure 5A including the retainer 60 formed from the pressing member 61 prevents such breakage of the elastic layer 571.

In the connection seal structure 5A, than in the structure where the pressing member 61 is not formed from the spring member 62 disposed at the connectable portion 75, the elastic member 57 is more easily kept in a bent state while being pressed with the spring force (urging force) of the spring member 62.

In the connection seal structure 5A, the gap between the elastic member 57 and the side wall surface 751*d* of the connectable portion is more easily closed, than in the structure where the bent end 57*a* of the elastic member 57 is not formed by bending the elastic layer 571 and in contact with the side wall surface 751*d* serving as the portion 75*d* of the connectable portion.

Figure 5A:
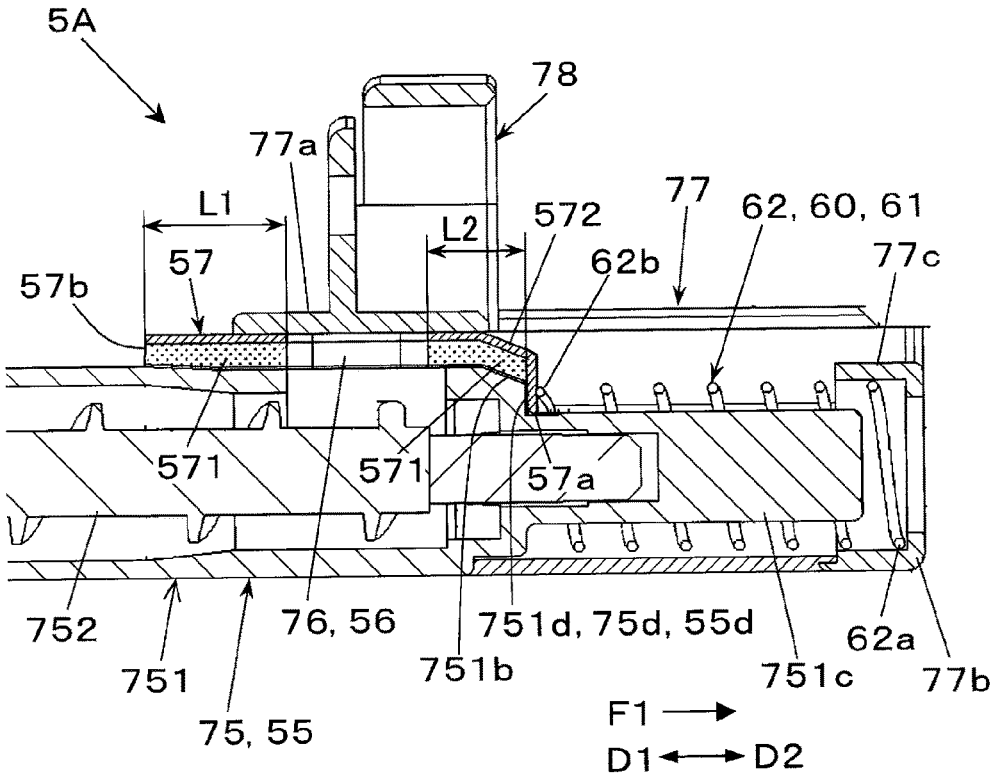
FIG. 5A is a schematic diagram of an example structure to be compared with the connection seal structure according to the first exemplary embodiment, partially illustrating in a cross section.

As illustrated in FIG. 5A, if the elastic layer 571 in the elastic member 57 in the connection seal structure 5A fails to come into contact with the side wall surface 751*d* serving as the portion 75*d* of the connectable portion, only the cover layer 572 of the elastic member 57 comes into contact with the side wall surface 751*d*, and the gap between the elastic member 57 and the side wall surface 751*d* of the connectable portion fails to be fully closed.

To preferably prevent leakage of a developer of powder with the elastic member 57 in the connection seal structure 5A, for example, lengths L1 and L2 from the inlet port 76 in the connectable portion 75 to the ends (for example, 57*a* and 57*b*) of the elastic layer 571 in the elastic member 57 are to be fully long, and the degree of adhesion (compressibility) of the connectable portion 75 to which the elastic layer 571 in the elastic member 57 is attached is to be fully high.

Figure 5B:
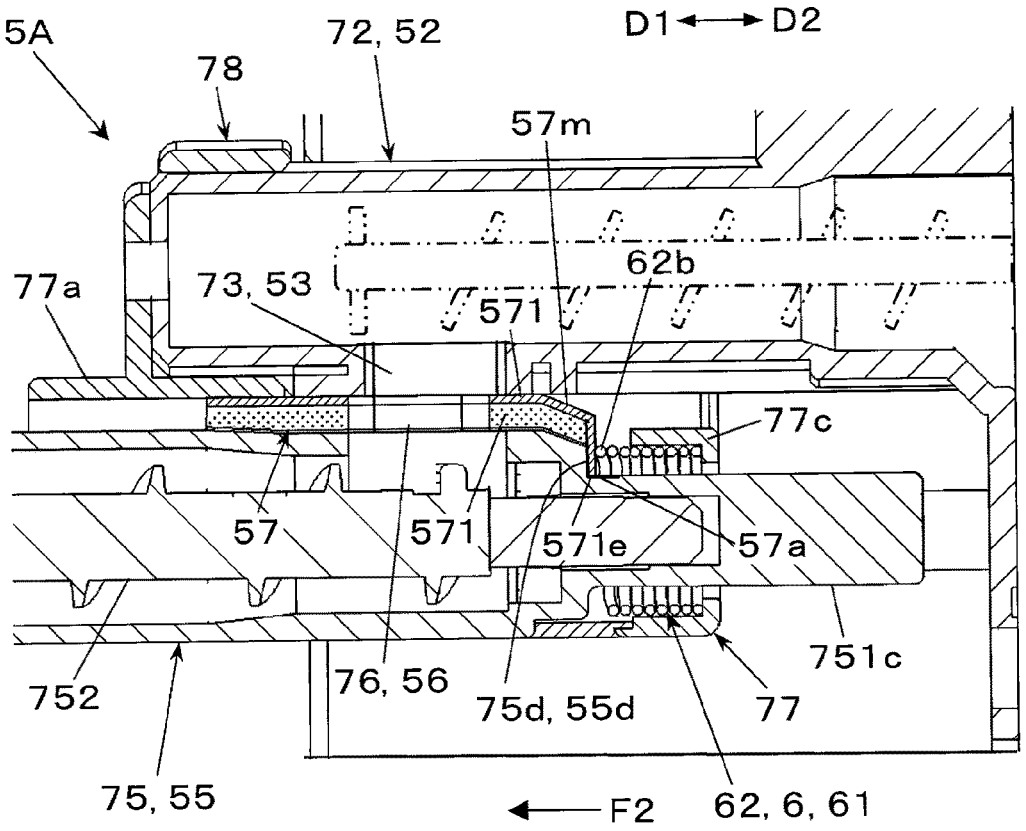
FIG. 5B is a schematic diagram of the example structure illustrated in FIG. 5A in a connected state, partially illustrating in a cross section.

Here, the connection seal structure 5A includes the elastic layer 571 that extends to the side wall surface 751*d* of the connectable portion, including the terminal end of the bent end 57*a* of the elastic member 57 (FIG. 2). Thus, in the connection seal structure 5A, the length L2 with respect to the bent end 57*a* of the elastic member 57 is longer than that in a structure where the elastic layer 571 extends to the middle of the bent end 57*a* without arriving at the side wall surface 751*d* of the connectable portion 75 (FIGS. 5A and 5B). Thus, the connection seal structure 5A is favorable for preventing developer leakage.

In the connection seal structure 5A, the bent end 57*a* of the elastic member 57 (elastic layer 571) is pressed against the side wall surface 751*d* of the connectable portion 75 by the spring member 62 of the pressing member 61 constituting the retainer 60, with the spring force F2*d* (FIG. 3) of the compressed spring member 62, and reliably compressed (FIG. 3). Thus, in the connection seal structure 5A, the portion of the elastic layer 571 at the bent end 57*a* in the elastic member 57 pressed by the pressing member 61 of the retainer 60 is more fully compressed and held in tight contact with the side wall surface 751*d* of the connectable portion 75 than in a structure where the bent end 57*a* of the elastic member 57 is not pressed by the spring member 62 of the pressing member 61 constituting the retainer 60. Thus, the connection seal structure 5A is favorable for preventing developer leakage.

Second Exemplary Embodiment

Figure 6A:
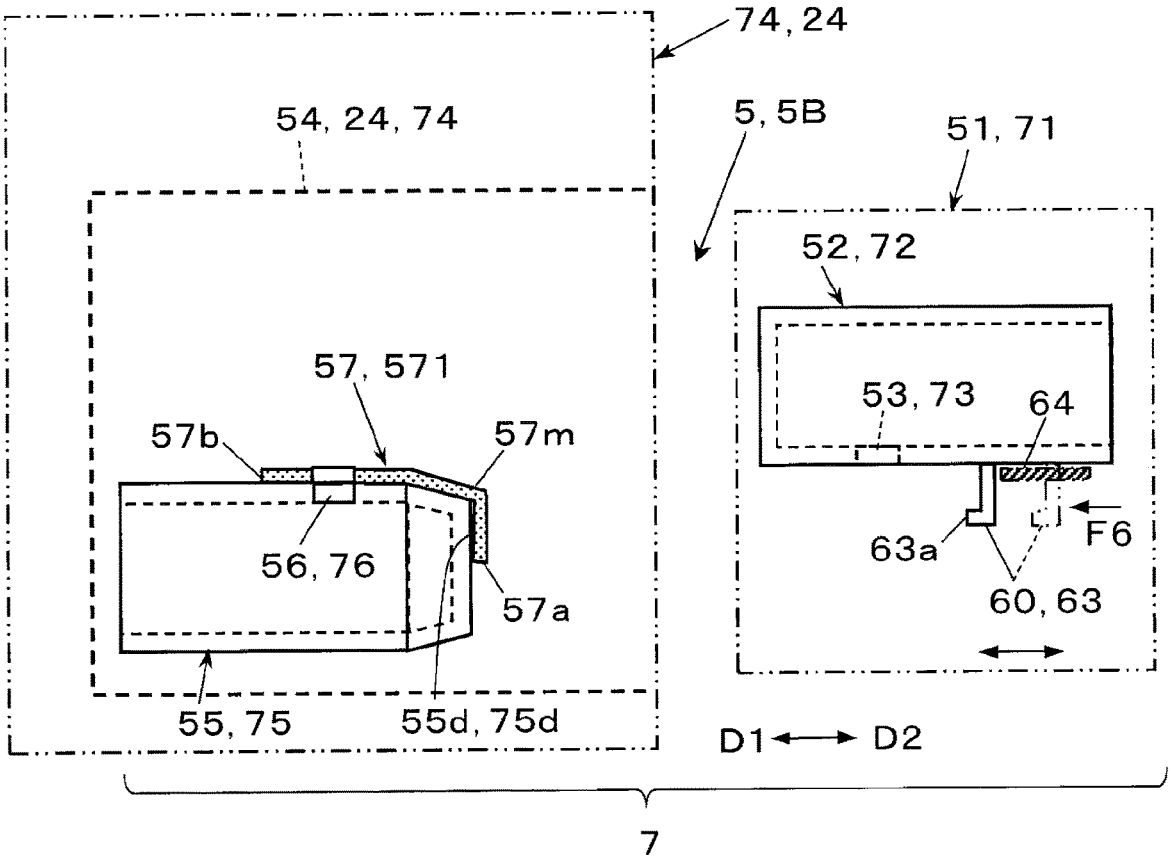
FIG. 6A is a schematic diagram of a connection seal structure according to a second exemplary embodiment in a disconnected state.
Figure 6B:
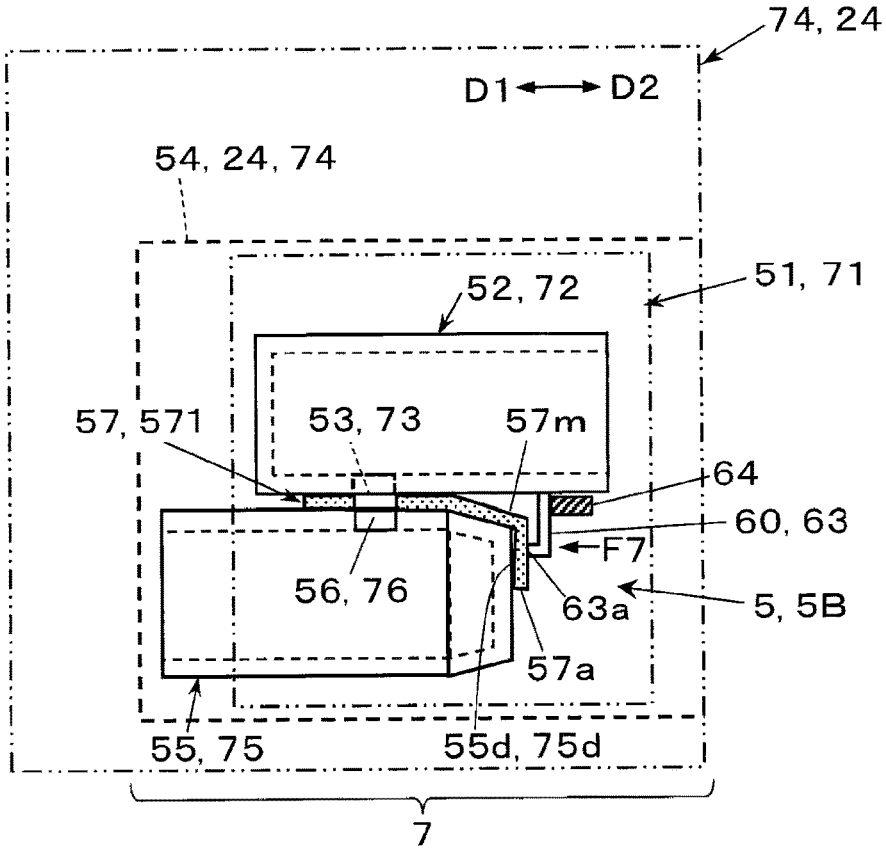
FIG. 6B is a schematic diagram of the connection seal structure illustrated in FIG. 6A in a connected state.

FIGS. 6A and 6B schematically illustrate a connection seal structure 5B according to a second exemplary embodiment.

The connection seal structure 5B is substantially the same as the connection seal structure 5 or 5A according to the first exemplary embodiment except that the connection seal structure 5B includes, in place of the spring member 62 of the pressing member 61 constituting the retainer 60, a contact member 63 that is located on the connector 52, and that comes into contact with the connectable portion 55 while the connector 52 is being connected to the connectable portion 55. FIGS. 6A and 6B omit illustration of a lid that opens or closes the inlet port 56 in the connectable portion 55.

As illustrated in FIG. 6A, the contact member 63 of the pressing member 61 constituting the retainer 60 has a shape including a contact portion 63*a* that comes into contact with the bent area 57*m* at the bent end 57*a* of the elastic member 57 in the connectable portion 55 to be pressed against the portion 55*d* of the connectable portion 55 when the connector 52 is inserted to be connected with the connectable portion 55.

The contact member 63 is attached to the outer peripheral portion of the connector 52 to be movable within a limited range in the insertion-removal direction D. The contact member 63 is urged in the insertion direction D1 with a predetermined urging force F6 by an urging member 64 such as a spring member disposed on the connector 52.

During insertion of the connector 52 and after the contact portion 63*a* comes into contact with the bent area 57*m* at the bent end 57*a* of the elastic member 57, the contact member 63 according to the second exemplary embodiment moves in the direction of arrow D2, against the urging force F6 of the urging member 64 until the connector 52 is connected to the connectable portion 55.

In the connection seal structure 5B including the retainer 60 constituted of the pressing member 61 formed from the contact member 63 and in the powder feeding device 7, the connector 52 in the first structure 51 is connected to the connectable portion 55 in the second structure 54 in the following manner.

Specifically, in the connection seal structure 5B, the connector 52 is moved in the insertion direction D1 toward the connectable portion 55.

Here, while the connector 52 is moving in the insertion direction D1 toward the connectable portion 55, the contact portion 63*a* of the contact member 63 on the connector 52 comes into contact with the bent area 57*m* at the bent end 57*a* of the elastic member 57 attached to the connectable portion 55.

Subsequently, the connector 52 moves to the position where it is connected to the connectable portion 55. Here, the contact member 63 moves on the connector 52, backward in the direction D2, opposite to the direction D1 in which the connector 52 is inserted, against the urging force F6 of the urging member 64.

As illustrated in FIG. 6B, in the connection seal structure 5B, the discharge port 53 in the connector 52 and the inlet port 56 in the connectable portion 55 face each other to be connected to each other, so that the connector 52 is connected to the connectable portion 55. Then, the contact portion 63*a* of the contact member 63 serving as another example of the pressing member 61 presses the bent area 57*m* at the bent end 57*a* of the elastic member 57 against the portion 55*d* of the connectable portion 55. Here, when the urging member 64 is a spring member such as a coil spring, the contact member 63 moves in the direction of arrow D2 to compress the spring member with the spring force F7.

Thus, the bent end 57*a* of the elastic member 57 is kept being bent by the pressure of the contact member 63. As in the case of the elastic member 57 according to the first exemplary embodiment, the elastic member 57 includes the elastic layer 571 and the cover layer 572. As in the case of the portion 55*d* of the connectable portion 55 according to the first exemplary embodiment, the portion 55*d* of the connectable portion 55 serves as a side wall surface at the tapered end of the connectable portion 55.

In the connection seal structure 5B where the connector 52 is connected to the connectable portion 55, when the connector 52 is to be connected to the connectable portion 55, the lower portion of the connector 52 passes by the elastic member 57 attached to the upper surface of the connectable portion 55 while coming into contact with the elastic member 57.

Here, the lower portion of the connector 52 does not come into contact with the bent area 57*m* at the bent end 57*a* of the elastic member 57 while the connector 52 is inserted.

On the other hand, the portion of the elastic member 57 other than the bent area 57*m* comes into contact with the lower portion of the inserted connector 52 and is rubbed by the lower portion in the direction of arrow D1 to receive external force. Here, since the contact member 63, serving as the pressing member 61, is pressed against the portion 55*d* of the connectable portion 55, the bent area 57*m* at the bent end 57*a* of the elastic member 57 is retained in a bent state without being deformed by the external force.

Here, when the urging member 64 urging the contact member 63 is a coil spring, the contact member 63 on the connector 52 is compressed while moving in the direction of arrow D2. Thus, the contact member 63 receives a larger spring force F7 (>F6) for restoring from the urging member 64, and a portion of the elastic layer 571 pressed by the contact portion 63*a* of the contact member 63 against the portion 55*d* of the connectable portion 55 is compressed with a stronger force than other portions. Thus, the bent area 57*m* of the elastic member 57 at the bent end 57*a* of the elastic member 57 is in pressure contact with the portion 55*d* of the connectable portion 55 to more reliably close the gap.

In the connection seal structure 5B, the connector 52 is disconnected from the connectable portion 55 in the following manner.

Specifically, in the connection seal structure 5B, the connector 52 is moved in the drawing-out direction D2 away from the connectable portion 55.

Here, the connector 52 moves away from the connectable portion 55. At this time, the contact member 63 starts moving back in the direction of arrow D1 in association with the movement of the connector 52 in the drawing-out direction D2 while receiving a restoring force of the urging member 64. When the contact member 63 on the connector 52 moves to the stop position in a disconnected state, the contact portion 63*a* is spaced apart from the bent area 57*m* at the bent end 57*a* of the elastic member 57.

Thus, as illustrated in FIG. 6A, in the connection seal structure 5B, the connector 52 is disconnected from the connectable portion 55 (in a disconnected state), so that the first structure 51 is removed from the second structure 54.

In the connection seal structure 5B where the connector 52 is disconnected from the connectable portion 55, when the connector 52 is drawn out from the connectable portion 55, the lower portion of the connector 52 passes by the elastic member 57 attached to the upper surface of the connectable portion 55 while coming into contact with the elastic member 57.

Here, the lower portion of the connector 52 is prevented from coming into contact with the bent area 57*m* at the bent end 57*a* of the elastic member 57 while the connector 52 is drawn out.

On the other hand, the portion of the elastic member 57 other than the bent area 57*m* comes into contact with the lower portion of the drawn-out the connector 52 and is rubbed by the lower portion in the direction of arrow D2 to receive external force. Here, since the contact member 63, serving as the pressing member 61 of the retainer 60, is pressed against the portion 55*d* of the connectable portion 55 to some extent, the bent area 57*m* at the bent end 57*a* of the elastic member 57 is retained in a bent state without being deformed by the external force.

Thus, in the connection seal structure 5B or the powder feeding device 7 including the connection seal structure 5B, the portion of the elastic member 57 attached to at least a portion of the connectable portion 55 (75) in the second structure 54 (powder receiving structure 74), on the side closer to the connector 52 (72) of the first structure 51 (powder feeding structure 71), is further prevented from being broken by insertion or removal of the connector 52 (72), than in a structure not including the retainer 60 (pressing member 61 formed from the contact member 63) that keeps the bent end 57*a* of the elastic member 57 in a bent state.

In the connection seal structure 5B, unlike in a structure where the pressing member 61 is not formed from the contact member 63, the elastic member 57 including the elastic layer 571 is temporarily released from the pressure from the contact member 63 while the connector 52 is disconnected. Thus, the elastic layer 571 in the elastic member 57 is restored by being released after being compressed with the pressure from the contact member 63, and thus keeps its resilience.

Third Exemplary Embodiment

Figure 7A:
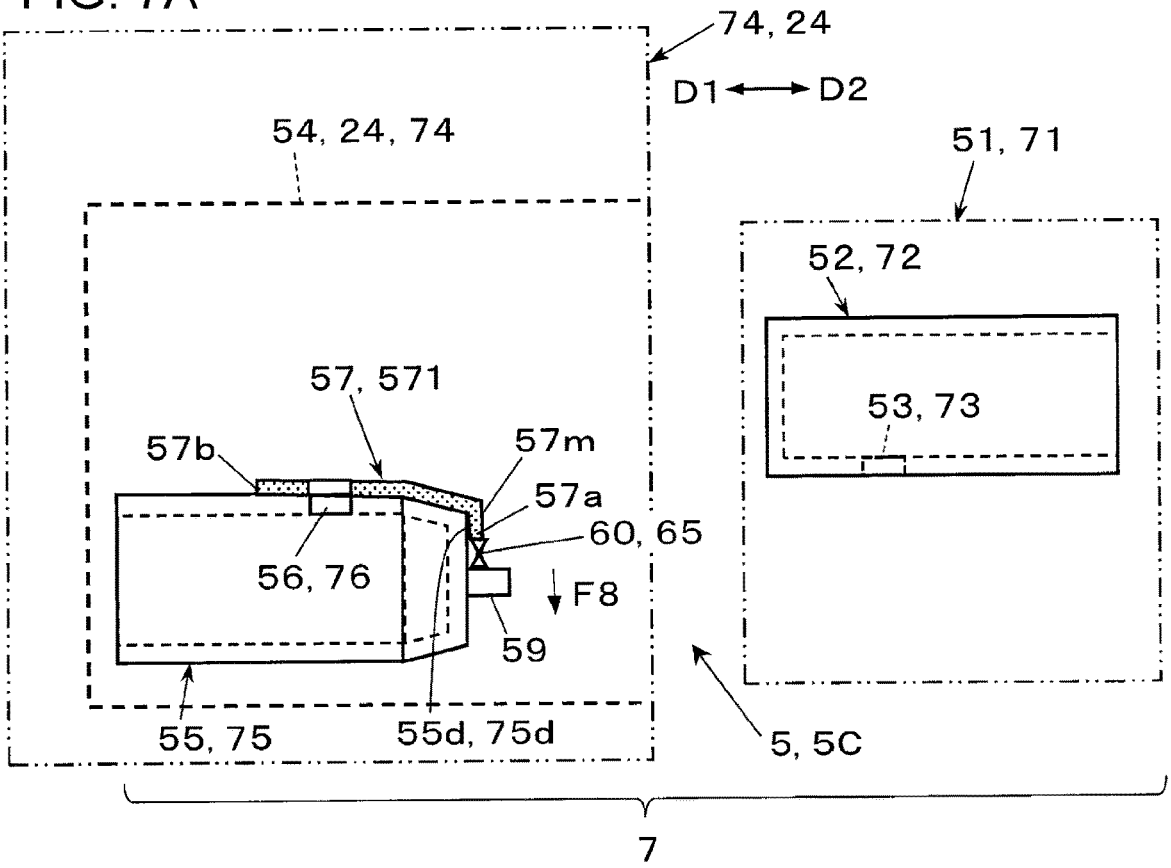
FIG. 7A is a schematic diagram of a connection seal structure according to a third exemplary embodiment in a disconnected state.
Figure 7B:
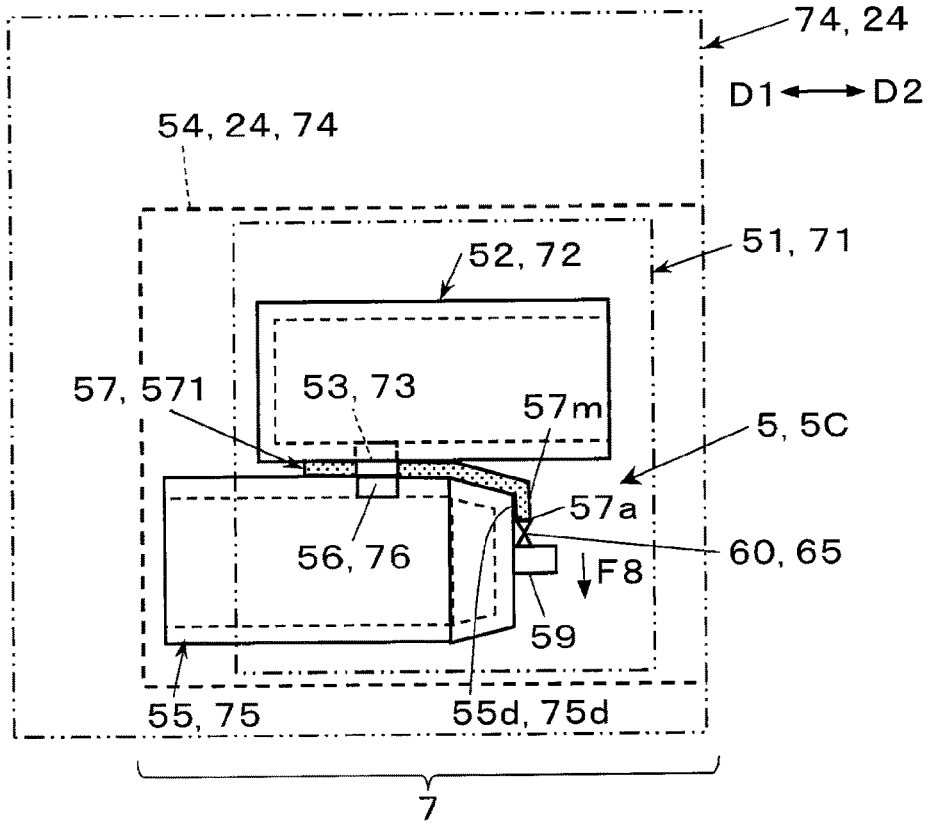
FIG. 7B is a schematic diagram of the connection seal structure illustrated in FIG. 7A in a connected state.

FIGS. 7A and 7B schematically illustrate a connection seal structure 5C according to a third exemplary embodiment.

The connection seal structure 5C is substantially the same as the connection seal structure 5 or 5A according to the first exemplary embodiment except that the connection seal structure 5C includes, in place of the retainer 60 formed from the pressing member 61, a retainer 60 formed from a member 65 that couples the bent end 57*a* of the elastic member 57 to the portion 55*d* of the connectable portion 55. FIGS. 7A and 7B also omit illustration of a lid that opens or closes the inlet port 56 in the connectable portion 55.

As illustrated in FIG. 7A, the coupling member 65 constituting the retainer 60 couples the bent end 57*a* of the elastic member 57 to the portion 55*d* of the connectable portion. The portion 55*d* of the connectable portion here may be an existing portion of the connectable portion 55 (such as the side wall surface 751*d* according to first exemplary embodiment), or an attachment portion 59 additionally provided. In the third exemplary embodiment, the attachment portion 59 such as an additionally provided protrusion is described as a typical example. In the third exemplary embodiment, the portion 55*d* of the connectable portion is a portion with which the bent end 57*a* of the elastic member 57 is in contact.

For example, the coupling member 65 includes an end holder that grips and holds the bent end 57*a* of the elastic member 57 at a first end, a fixing portion that is fixed to the attachment portion 59 of the connectable portion 55 at a second end, and a coupler that couples the end holder and the fixing portion to be integrated together.

The coupling member 65 fixes the fixing portion to the attachment portion 59 of the connectable portion 55 to allow the bent end 57*a* of the elastic member 57 to be in contact with the portion 55*d* of the connectable portion. Thus, the bent end 57*a* of the elastic member 57 is kept being coupled to the attachment portion 59. Here, in view of fully keeping the bent end 57*a* of the elastic member 57 in a bent state, the coupling member 65 is preferably attached with almost no looseness (slack). Thus, the bent end 57*a* of the elastic member 57 is kept being in contact with the portion 55*d* of the connectable portion. Also in this case, the bent end 57*a* of the elastic member 57 is preferably bonded to the portion 55*d* of the connectable portion.

In the connection seal structure 5C including the retainer 60 formed from the coupling member 65, when the connector 52 move in the direction D1 in which the connector 52 is inserted to be connected to the connectable portion 55, as illustrated in FIG. 7B, the lower portion of the connector 52 passes by the elastic member 57 attached to the upper surface of the connectable portion 55 while coming into contact with the elastic member 57.

Here, the lower portion of the connector 52 is prevented from coming into contact with the bent area 57*m* at the bent end 57*a* of the elastic member 57 when the connector 52 is inserted.

On the other hand, the portion of the elastic member 57 other than the bent area 57*m* comes into contact with the lower portion of the inserted connector 52 and is rubbed by the lower portion in the direction of arrow D1 to receive external force. Here, since the bent area 57*m* at the bent end 57*a* of the elastic member 57 is coupled to the attachment portion 59 of the connectable portion 55 with the coupling member 65 formed from the pressing member 61, the bent area 57*m* is retained in a bent state without being deformed by the external force.

In the connection seal structure 5C, when the connector 52 moves in the drawing-out direction D2 to be disconnected from the connectable portion 55, the lower portion of the connector 52 passes by the elastic member 57 attached to the upper surface of the connectable portion 55 while coming into contact with the elastic member 57.

Here, the lower portion of the connector 52 is prevented from coming into contact with the bent area 57*m* at the bent end 57*a* of the elastic member 57 when the connector 52 is drawn out.

On the other hand, the portion of the elastic member 57 other than the bent area 57*m* comes into contact with the lower portion of the drawn-out the connector 52 and is rubbed by the lower portion in the direction of arrow D2 to receive external force. Here, since the bent area 57*m* at the bent end 57*a* of the elastic member 57 is coupled to the attachment portion 59 of the connectable portion 55 with the coupling member 65 of the retainer 60, the bent area 57*m* is retained in a bent state without being deformed by the external force.

Thus, in the connection seal structure 5C or the powder feeding device 7 including the connection seal structure 5C, the portion of the elastic member 57 attached to at least a portion of the connectable portion 55 (75) in the second structure 54 (powder receiving structure 74), on a side closer to the connector 52 (72) of the first structure 51 (powder feeding structure 71), is further prevented from being broken by insertion or removal of the connector 52 (72), than in a structure not including the retainer 60 (coupling member 65) that keeps the bent end 57*a* of the elastic member 57 in a bent state.

Other Modification Examples

In the first to third exemplary embodiments, the developer feeding device 7A that feeds a developer as an example of powder is described as the powder feeding device 7 including the connection seal structure 5A, 5B, or 5C. However, for the powder feeding device 7, other powder feeding devices that feed other powder may be employed, instead.

Figure 8A:
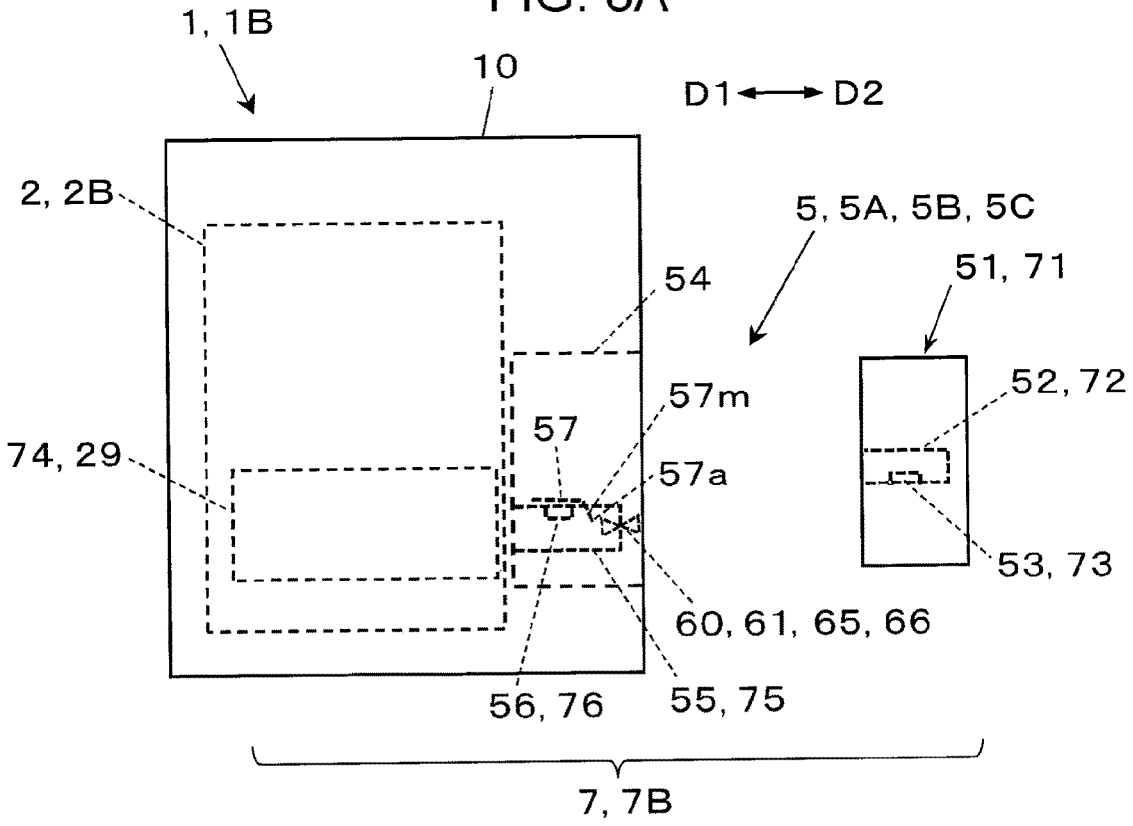
FIG. 8A is a schematic diagram of a connection seal structure according to a modification example in a disconnected state.
Figure 8B:
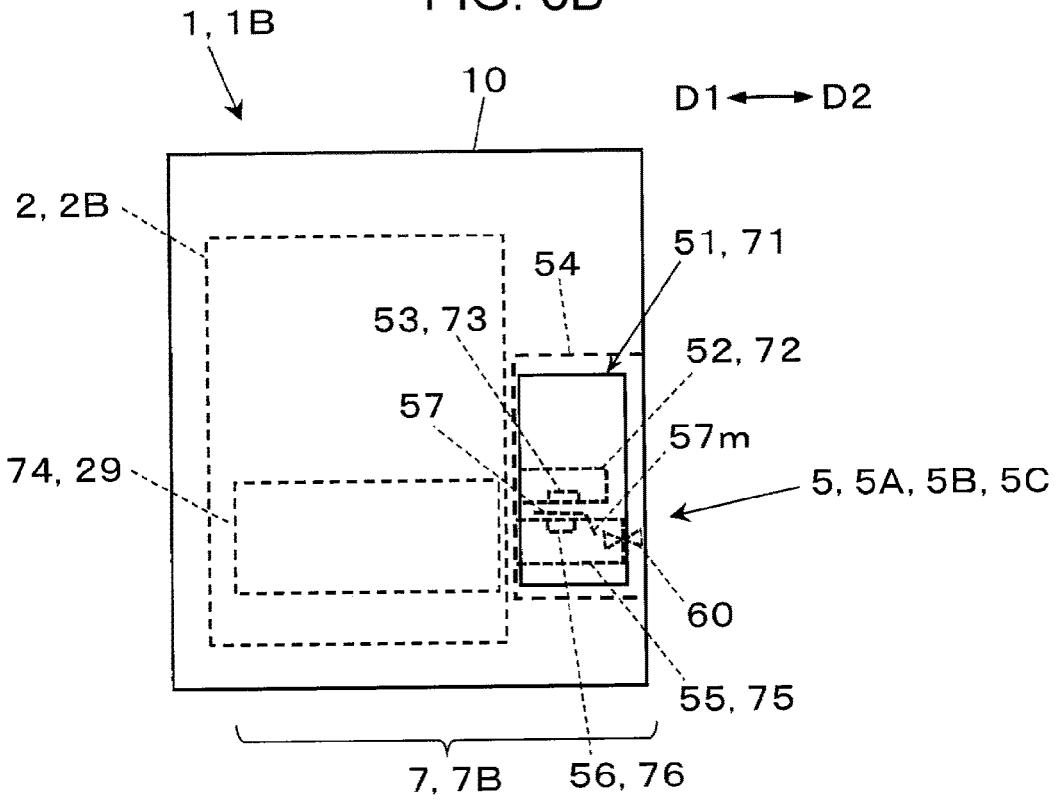
FIG. 8B is a schematic diagram of the connection seal structure illustrated in FIG. 8A in a connected state.

As illustrated in FIGS. 8A and 8B, examples of the powder feeding device 7 include a powder paint feeding device 7B that feeds a powder paint, serving as an example of powder. In the powder paint feeding device 7B, the powder feeding structure 71 serves as a structure that accommodates the powder paint, and the powder receiving structure 74 serves as a structure that receives the powder paint fed from the powder feeding structure 71.

The powder paint feeding device 7B is capable of further preventing leakage of the powder paint at the connected portion in the connection seal structure 5A, 5B, or 5C than in the case where the connection seal structure 5A, 5B, or 5C does not include the retainer 60, regardless of repeated insertion and removal of the powder feeding structure 71.

In the first to third exemplary embodiments, the image forming apparatus 1A that handles a developer as an example of powder is described as the powder handling device 1 including the powder feeding device 7 including the connection seal structure 5A, 5B, or 5C. However, for the powder handling device 1, other powder handling devices that handle other powder may be employed, instead.

As illustrated in FIGS. 8A and 8B, examples of the powder handling device 1 include a powder application device 1B including the powder applying device 2 that applies a powder paint to a receiving object (such as a metal sheet) when the powder is a powder paint. In the powder application device 1B, the powder applying device 2 serves as a powder paint applying device 2B that applies the powder paint to the receiving object. For example, the powder paint applying device 2B includes a powder paint applying roller that holds the powder paint and applies a predetermined amount of the powder paint with a predetermined pattern to the receiving object.

The powder application device 1B is capable of further preventing leakage of the powder paint at the connected portion in the connection seal structure 5A, 5B, or 5C than in the powder paint feeding device 7B where the connection seal structure 5A, 5B, or 5C does not include the retainer 60, regardless of repeated insertion and removal of the powder feeding structure 71 in the powder paint feeding device 7B.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A connection seal structure, comprising:

a first structure including a connector that is removably connected; and a second structure that includes a connectable portion that is configured such that the connector to be received thereon and connected thereto, the connectable portion configured such that an elastic member including an elastic layer is attachable to at least a portion of the connectable portion configured to face the connector when the connector is connected to the connectable portion, wherein the elastic member has an end bent in such a direction as not to come into contact with the connector while the connector is inserted or removed, the end being on a side closer to the connector while the connector is inserted, and wherein the connection seal structure further comprises a retainer that keeps the bent end of the elastic member in a bent state.

2. The connection seal structure according to claim 1, wherein the retainer is formed from either a pressing member that presses the bent end of the elastic member against a portion of the connectable portion in a direction in which the connector is inserted, or a coupling member that couples the bent end of the elastic member with the portion of the connectable portion.

3. The connection seal structure according to claim 2, wherein the pressing member is formed from a spring member disposed at the connectable portion.

4. The connection seal structure according to claim 2, wherein the pressing member is formed from a contact member disposed on the connector to come into contact with the connectable portion while the connector is being connected to the connectable portion.

5. The connection seal structure according to claim 1, wherein the bent end of the elastic member includes a bent portion of the elastic layer and is configured to contact with a portion of the connectable portion after inserting the connector.

6. The connection seal structure according to claim 5, wherein the bent portion of the elastic layer is bonded to the portion of the connectable portion.

7. A powder feeding device, comprising:

a powder feeding structure as the first structure that includes the connector that is removably connected, and a discharge port formed in the connector to discharge therethrough powder to be fed;

a powder receiving structure as the second structure that includes the connectable portion that allows the connector to be received thereon and connected thereto, and an inlet port formed in the connectable portion to face the discharge port to receive the discharged powder; and the connection seal structure including the elastic member including the elastic layer attached to a portion of the connectable portion covering at least a surrounding of the inlet port to prevent leakage of powder between the connectable portion and the connector, wherein the connection seal structure is formed from the connection seal structure according to claim 1.

8. The powder feeding device according to claim 7, wherein the connectable portion includes:

a lid that is attached while being movable in association with insertion or removal of the connector to open or close the inlet port; and a spring member disposed downstream from the inlet port in a direction opposite to a direction in which the connector is inserted, the spring member urging the lid in the direction opposite to the direction in which the connector is inserted to keep the lid in a closed state, wherein the pressing member is formed from the spring member, and wherein the spring member is located while having an end that faces the connectable portion in contact with a bent end of the elastic member and while pressing the bent end against a portion of the connectable portion.

9. A powder handling device, comprising:

a powder applying device that applies powder to a receiving object; and a powder feeding device that feeds the powder to the powder applying device, wherein the powder feeding device includes the powder feeding device according to claim 7.

* * * * *